US008419088B2

(12) United States Patent
Baic et al.

(10) Patent No.: US 8,419,088 B2
(45) Date of Patent: Apr. 16, 2013

(54) LATCHES AND LATCHING SYSTEMS HAVING A POSITIVE STATUS INDICATOR

(75) Inventors: Zarko Baic, Sylmar, CA (US); Zeljko Baic, Sylmar, CA (US)

(73) Assignee: Avibank Manufacturing, Inc., North Hollywood, CA (US)

( * ) Notice: Subject to any disclaimer, the term of this patent is extended or adjusted under 35 U.S.C. 154(b) by 910 days.

(21) Appl. No.: 12/316,866

(22) Filed: Dec. 16, 2008

(65) Prior Publication Data

US 2009/0151409 A1 Jun. 18, 2009

Related U.S. Application Data

(60) Provisional application No. 61/008,038, filed on Dec. 17, 2007.

(51) Int. Cl.
*E05C 3/02* (2006.01)

(52) U.S. Cl.
USPC ..... 292/194; 292/200; 292/63; 292/DIG. 31

(58) Field of Classification Search ..... 292/63–69, 292/194, 195, 197, 198, 200, 202, 300, DIG. 31, 292/44, 45, 47, 49, 52, 54, 55
See application file for complete search history.

(56) References Cited

U.S. PATENT DOCUMENTS 1,613,315 A * 1/1927 Dols ..... 292/257
1,731,680 A * 10/1929 Mueller ..... 292/67
2,919,569 A * 1/1960 Davis ..... 70/97
2,931,676 A * 4/1960 Wroughton ..... 292/211
4,265,474 A * 5/1981 Poe ..... 292/241
4,389,062 A * 6/1983 Rosenberg ..... 292/190
4,395,000 A * 7/1983 Deviny et al. ..... 244/118.3
4,503,584 A * 3/1985 Malchow ..... 16/232
4,549,708 A * 10/1985 Norris ..... 244/129.4
4,555,078 A * 11/1985 Grognard ..... 244/54
4,671,547 A * 6/1987 Weinerman et al. ..... 292/197
4,679,750 A * 7/1987 Burhans ..... 244/129.4
4,793,643 A * 12/1988 Ahad et al. ..... 292/241
4,844,524 A * 7/1989 Pastva ..... 292/218
4,911,485 A 3/1990 Wasilewski
5,518,206 A * 5/1996 Arnold et al. ..... 244/129.4
5,620,212 A * 4/1997 Bourne et al. ..... 292/113
6,032,901 A * 3/2000 Carimali et al. ..... 244/129.4
6,428,060 B1 * 8/2002 Metz ..... 292/227
6,513,353 B1 * 2/2003 Weinerman et al. ..... 70/208
6,626,017 B2 * 9/2003 Herbeck et al. ..... 70/63
6,786,519 B2 * 9/2004 Gartner ..... 292/195
6,945,573 B2 * 9/2005 Ruiz et al. ..... 292/109

(Continued)

*Primary Examiner* — Carlos Lugo
*Assistant Examiner* — Mark Williams
(74) *Attorney, Agent, or Firm* — James M. Duncan, Esq.; Klein, DeNatale, Goldner

(57) ABSTRACT

A status indicating latch comprises a housing having a flange, and the flange has a plurality of apertures transversing the flange. A plurality of attachment means attach the housing flange to a panel. The panel further comprises an activation tool port that an activation tool is inserted into. The activation tool rotates a rotatable lock mechanism disposed within the housing. The lock mechanism comprises a shaft, an activation tool engagement member, a plunger disposed within the shaft and connected to the activation tool engagement member, a cam operatively connected to said plunger, and a plunger biasing means that biases the plunger upwards when the lock mechanism is locked. A guide operatively connected to the cam operates upon a pivot arm that is pivotally connected to the housing and slidably connected to the guide.

20 Claims, 8 Drawing Sheets

U.S. PATENT DOCUMENTS

| | | | | |
|---|---|---|---|---|
| 7,066,501 | B2 | 6/2006 | Meineke et al. | |
| 7,185,926 | B2 * | 3/2007 | Helsley et al. | 292/113 |
| 7,204,458 | B2 * | 4/2007 | Porte et al. | 244/129.4 |
| 7,448,656 | B1 | 11/2008 | Hein et al. | |
| 7,735,778 | B2 * | 6/2010 | Lair et al. | 244/110 B |
| 7,994,940 | B2 * | 8/2011 | Grichener et al. | 340/945 |
| 2005/0067843 | A1 * | 3/2005 | Peng et al. | 292/336 |
| 2006/0202087 | A1 * | 9/2006 | Mortland | 244/129.5 |
| 2008/0012357 | A1 * | 1/2008 | Liang et al. | 292/240 |
| 2008/0042452 | A1 * | 2/2008 | Moon et al. | 292/337 |
| 2009/0151409 | A1 * | 6/2009 | Baic et al. | 70/157 |

* cited by examiner

LATCHES AND LATCHING SYSTEMS HAVING A POSITIVE STATUS INDICATOR

CROSS-REFERENCE TO RELATED APPLICATIONS

U.S. Provisional Application No. 61/008,038 for this invention was filed on Dec. 17, 2007, for which application these inventors claim domestic priority.

BACKGROUND OF THE INVENTION

This invention generally relates to latches for panels and doors, particularly latches for panels and doors used for aircraft applications. This invention specifically relates to latches which may be used either individually or cooperatively linked together such that all of the linked latches are activated by the activation of a single latch in the series. Each latch in the series provides a positive indication of the status of the latch, thus indicating whether the latches in the series of latches are in the locked or unlocked position.

Latches and latch systems utilized for aircraft panels and compartment closures should be relatively easy to open and close. If such latch systems are utilized on the exterior of the aircraft, for aerodynamic reasons the components of the latch system should be flush with the exterior skin of the aircraft In addition to providing relative ease in opening and closing of the latch, the latch should also provide a positive locking feature. It is also desirable that the latch provide a positive visual indication of whether the latch is in the locked position or the unlocked position.

BRIEF DESCRIPTION OF THE INVENTION

The present invention is directed to a flush mount latch which provides a positive visual indication of whether the latch is in the locked or unlocked position by the use of a position indicating plunger. In the locked position, the plunger is flush with the exterior skin of the aircraft. In the unlocked position, the plunger is recessed below the exterior skin of the aircraft. The relative position of the plunger with respect to the exterior skin of the aircraft provides the positive visual indication of whether the latch is locked or unlocked. Embodiments of this latch may be linked together to comprise a latch system which may be operated from a single point, whereby the locking or unlocking of one of the latched in a linked series of latches places the linked latches in the same status as the latch manipulated. An embodiment of this apparatus may be used on exterior doors or panels of aircraft. The latch may be attached to the bottom surface of the skin of the aircraft with the plunger protruding through a hole in the skin, so that the plunger is flush with the surface of the skin when the latch is locked and beneath the surface of the skin when the latch is unlocked. The plunger height is adjustable so that it may be adjusted in accord with the skin thickness.

During flight, the aircraft door is closed and kept locked utilizing the latch or latching system. While in flight, the plunger is flush with the exterior skin of the aircraft. To open the latch, a tool, such as a hex wrench, is placed against the plunger and depressed and the hex tool engages a hex drive within a shaft which is rotated with the wrench. As the hex wrench rotates the hex drive, the shaft is rotated causing a rotating lock mechanism to transfer motion to a cam, a guide, and a pivot arm, causing the latch to open. The plunger remains depressed so long as the latch is in the open position, such that a visual examination of the latch immediately confirms that the latch is not locked. Rotation of the hex tool in the opposite direction causes the latch to close, and the plunger to rise into a flush position when the latch is in the closed position.

Multiple latches may be linked or ganged together. In these configurations, a group or series of latches may be operated from a single point by connecting adjacent latches together, as can be accomplished with bellcrank rods, for example. Manipulating a first latch into either an open or closed position with a hex wrench causes latches tied together to the first latch to be manipulated into the same position as the first latch. The latches utilized in the multiple latch system also have a positive indicator showing whether each latch is in the locked or open position, as the plunger is biased into the same position as the manipulated latch.

DETAILED DESCRIPTION OF THE INVENTION

Referring now to the Figures, FIGS. 1 through 12 show various views of an embodiment of the disclosed latch 10.

Figure 1:
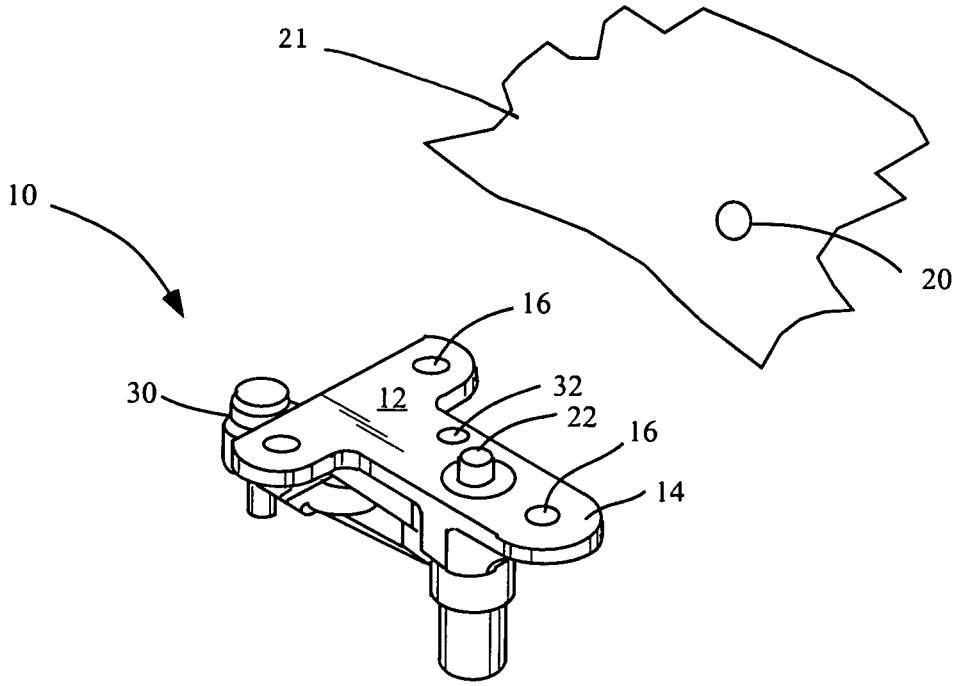
FIG. 1 shows an isometric view of an embodiment of the present latch in the locked position, viewed from the top, with the plunger in the raised position.
Figure 2:
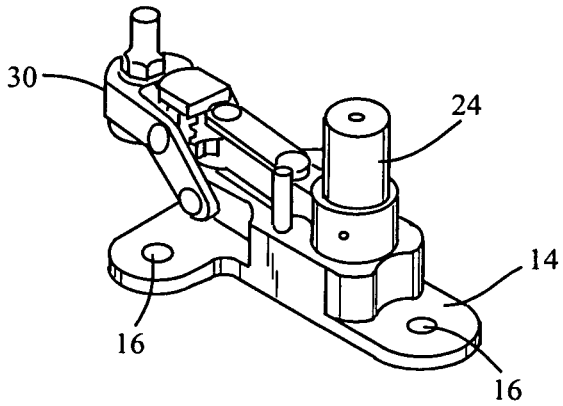
FIG. 2 shows an isometric view of an embodiment of the latch of FIG. 1, viewed from the bottom.
Figure 3:
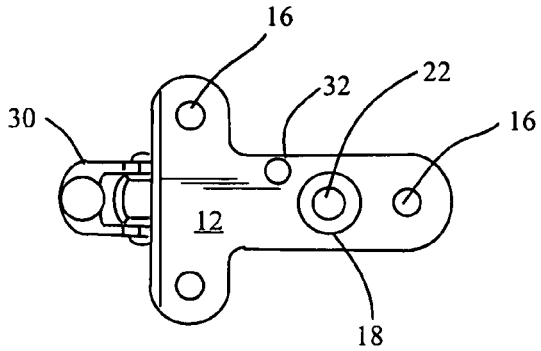
FIG. 3 shows a top view of an embodiment of the latch shown in FIGS. 1 and 2, where the latch is shown in the locked position.

FIG. 1 shows an isometric view of an embodiment of the present latch 10 in the locked position, viewed from the top, with the plunger 22 in the raised position above the housing 12, as the latch is in the locked position. The plunger 22 would be flush with the activation tool port 20 transversing the panel 21. The apertures 16 used to attach the flange 14 to the panel 21 are shown as three in number, but more or less apertures 16 can be used depending upon the application. The top of the movement stop 32 can be seen, and the movement stop 32 depends from the housing 12 and blocks rotation of the cam 24 and guide 28 in the direction of the movement stop 32, thereby limiting the imparted rotational movement direction to the unblocked direction. The pivot arm 30 can be seen, but is better shown in other Figures. FIG. 2 shows an isometric view of an embodiment of the latch of FIG. 1, viewed from the bottom. The pivot arm 30 can be seen, as can the cam 24. The flange 14 and apertures 16 are also shown. Referring to FIG. 3, shown is a top view of an embodiment of the latch shown in FIGS. 1 and 2, where the latch is shown in the locked position. The top of the pivot arm 30 is shown, and the plunger 22, the shaft 18 and housing 12 can be seen, as can apertures 16.

Figure 5:
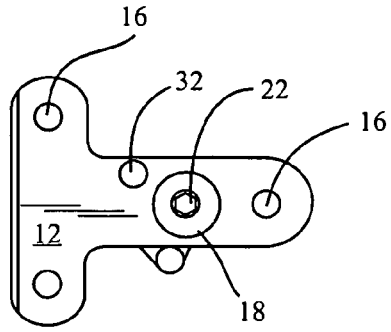
FIG. 5 shows a top view of an embodiment of the latch shown in FIG. 1 in the unlocked position.
Figure 4:
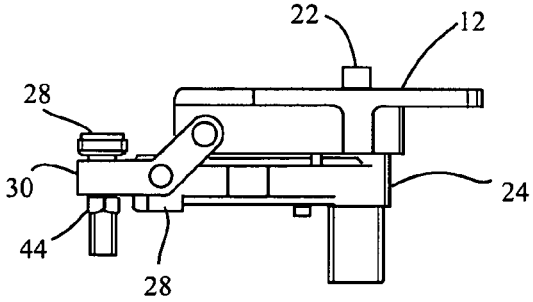
FIG. 4 shows a side view of the embodiment shown in FIG. 3, also in the locked position.
Figure 6:
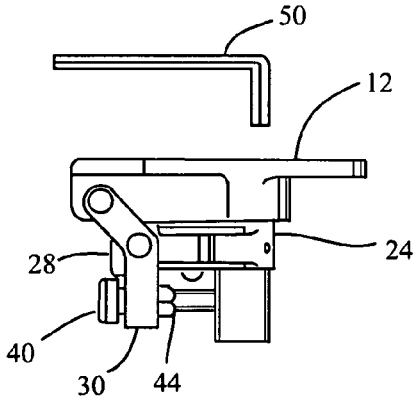
FIG. 6 shows a side view of an embodiment of the latch shown in FIG. 1 in the unlocked position.

FIG. 4 shows a side view of the embodiment shown in FIG. 3, also in the locked position. The screw subassembly that can comprise the pivot arm 30 can be partially seen, as the screw 40 and the self-locking nut 44 are shown. The plunger 22 can be seen as above the housing 12. The cam 24 and guide 28 can also be seen. FIG. 5 shows a top view of an embodiment of the latch shown in FIG. 1 in the unlocked position. The pivot arm 30 cannot be seen as the pivot arm 30 has pivoted relative to the housing 12, and is now beneath the housing 12, as can be seen in FIG. 6. The cam 24 and guide 28 can be linked together through the use of conventional linkages that transmit the rotational force. The screw 40 and locking nut 44 of the screw subassembly can be seen as further comprising the pivot arm 30. FIG. 6 shows a side view of an embodiment of the latch shown in FIG. 1 in the unlocked position. The plunger 22 cannot be seen above the housing 12, and the activation tool 50, shown as a hex wrench, can be seen above the latch. The cam 24 and guide 28 are shown closer together, as the force exerted upon the guide 28 from the transfer of the rotational movement of the lock mechanism is transmitted to the guide 28 through the cam 24.

Figure 7:
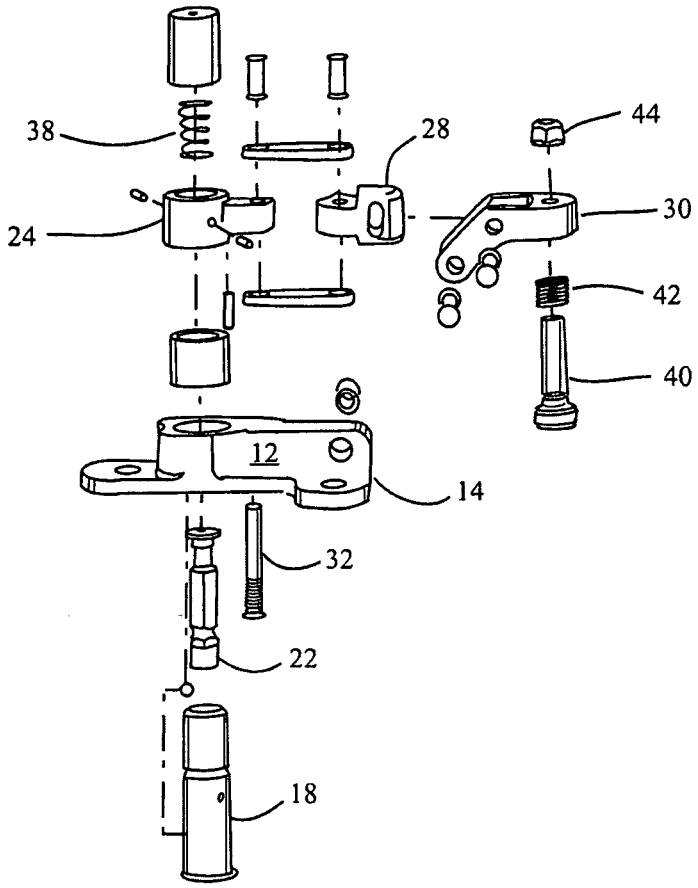
FIG. 7 shows an exploded view of the embodiment of the disclosed latch shown in FIG. 1.
Figure 8:
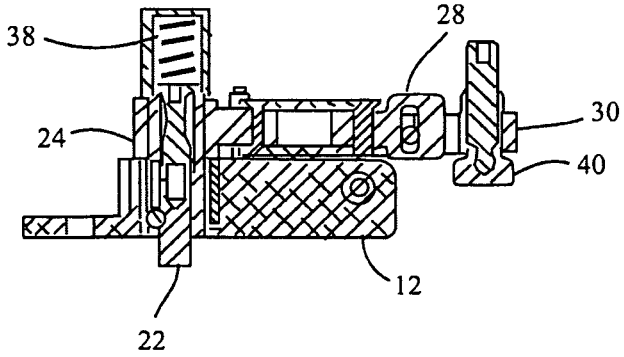
FIG. 8 shows a sectional view of the embodiment shown in FIG. 7.

Referring to FIG. 7, an exploded view of an embodiment of the disclosed latch is shown. The housing 12 and the flange 14 are shown, and the flange 14 is used to mount the housing 12 to a panel, which would generally be an aircraft panel. The rotatable lock mechanism comprises a shaft 18 disposed within the housing 12, a plunger 22 disposed within the shaft 18, and a cam 24 operatively connected to the plunger 22 can be seen. The biasing means 38 is shown as a spring. The cam 24 is operatively connected to the guide 28, and the rotational movement of the cam 24 transmitted to the guide 28 is directionally limited by the movement stop 32. The guide 28 in turn transmits the rotational movement from the cam 24 into a movement transferred to the pivot arm 30 resulting in a pulling motion, which causes the pivot arm 30 to pivot at the connection of the pivot arm 30 to the housing 12. The pivot arm 30 can be attached to the housing 12 and the guide 28 using rivets or other mechanical means. The screw subassembly can also be seen as the screw 40, locking insert 42, and self-locking nut 44 are shown. FIG. 8 shows a sectional view of the embodiment shown in FIG. 7, and the biasing means 38 is shown as biasing the plunger 22 above the housing 12. The pivot arm 30 and the screw 40 are shown. The guide 28 and the cam 24 lie in a parallel plane to the upper surface of the housing 12.

Figure 9:
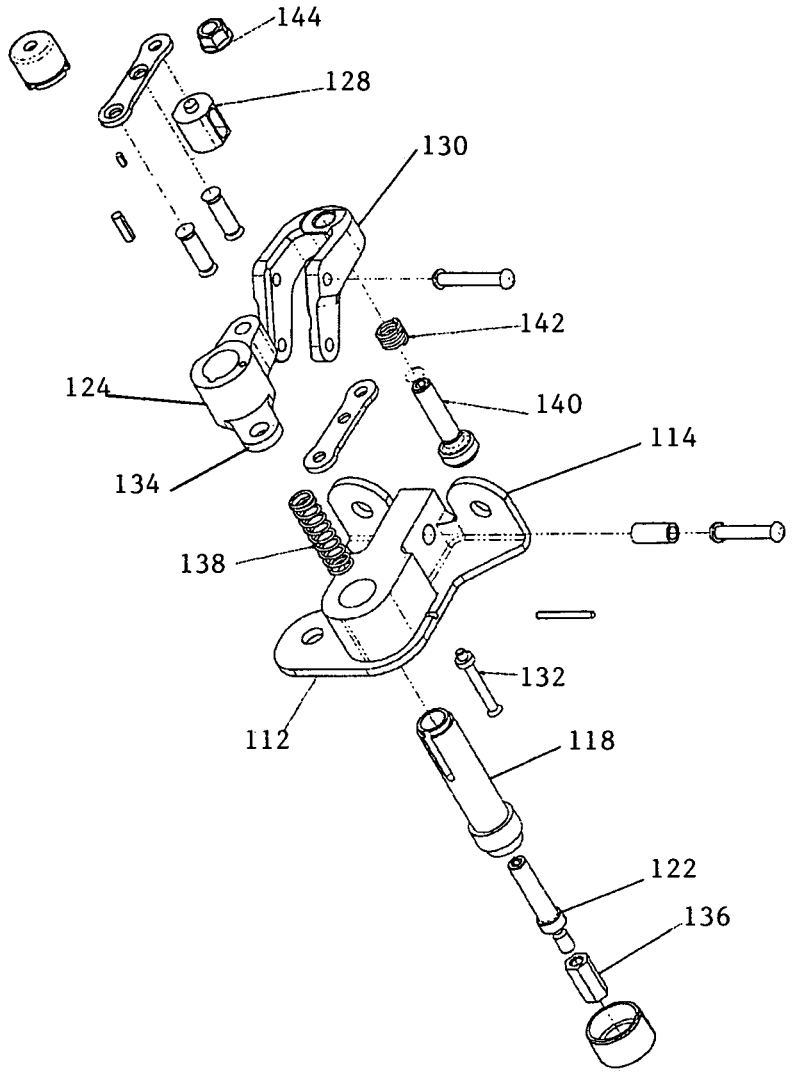
FIG. 9 shows an exploded view of an alternate embodiment of the latch.

Referring to FIG. 9, an exploded view of an alternate embodiment of the disclosed latch is shown. The latch comprises a housing 112, a flange 114, a rotational lock mechanism that comprises a shaft 118, a plunger 122 disposed within the shaft 118, a biasing means 138 that biases the plunger 122, and a cam 124 operatively linked to the plunger 122 and moved by the rotation exerted upon the rotatable lock mechanism when the latch is locked or unlocked. The biasing means 138 biases the plunger 122 upwards in the locked position and is compressed by the plunger 122 in the unlocked position. The cam 124 is linked to a guide 128, and the guide 128 transfers the rotational force to raise the pivot arm 130 when the latch is being unlocked. The cam 124 can also comprise a link rod attachment member 134, such that the latches may be linked in series. The pivot arm 130 can comprise an adjustable screw subassembly comprising a screw 140, a screw locking insert 142, and a self-locking nut 144. As can be seen, the flange 114 provides an alternate mounting placement on the aircraft panel, but it is to be appreciated that the panel would include an activation tool insertion port. The activation tool engagement member can comprise a hex shaft 136 that would be engaged by and acted upon by a hex wrench or hex tool. The movement stop 132 directs the rotational force of the lock mechanism in one direction.

Figure 10:
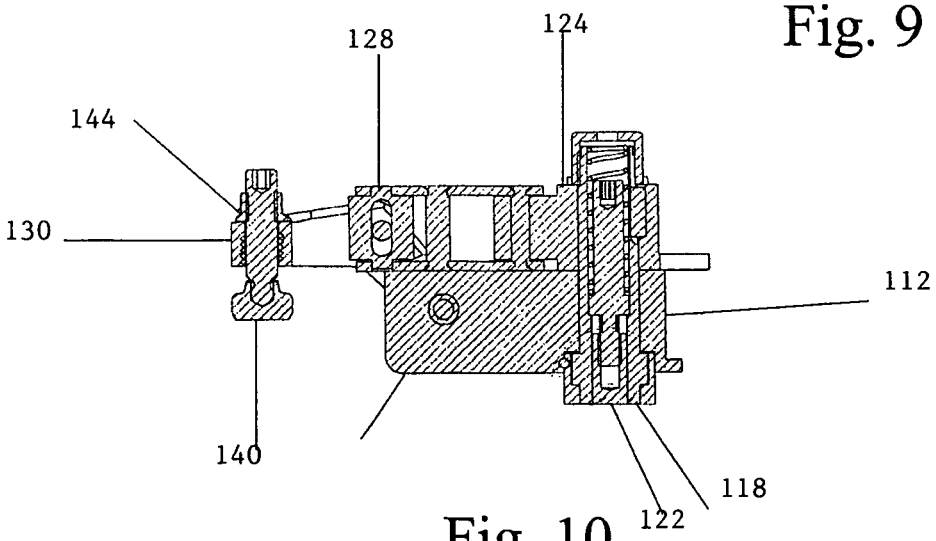
FIG. 10 shows a sectional view of the embodiment of the disclosed latch shown in FIG. 9.

FIG. 10 shows a sectional view of the embodiment shown in FIG. 9, and the assembly of the latch can be seen. The slidable attachment of the pivot arm 130 to the guide 128 can be clearly seen in this Figure. As the guide 128 transmits the movement to the pivot arm 130, the pivot arm 130 moves in an arc relative to the housing 112 thus moving the pivot arm 130 out of engagement with the panel and allowing the panel to be opened. The cam 124 and the guide 128 are further apart as the latch is in the locked position, and the cam 124 and the guide 128 are drawn closer together by the movement imparted by the rotation of the lock mechanism.

Figure 11:
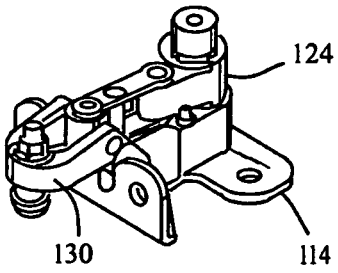
FIG. 11 shows a perspective view of the bottom of the alternate embodiment of the latch shown in FIG. 9 in the locked position.
Figure 12:
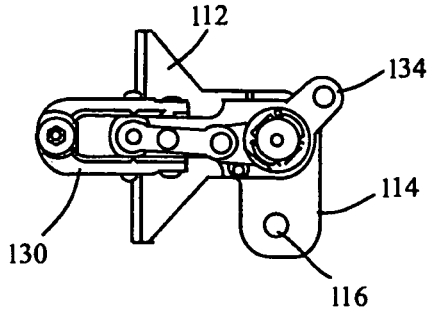
FIG. 12 shows an isometric view of an embodiment of the latch of FIG. 11, viewed from the bottom.

FIGS. 11 through 15 show various views of the alternate embodiment of the disclosed latch shown in FIGS. 9 and 10. Referring to FIG. 11, a perspective view of an embodiment of the present latch is shown in the locked position, with the pivot arm 130 in the locked position, wherein the pivot arm 130 is aligned with the cam 124. The flange 114 can be clearly seen, and the flange would abut the panel to which the latch was mounted. FIG. 12 shows an isometric view of an embodiment of the latch of FIG. 11, viewed from the bottom. The housing 112, the flange 114 and an aperture 116 through the flange 114 for attaching the latch to a panel can be seen. The pivot arm 130 is aligned with the housing 112 surface and therefore the latch is in the locked position.

Figure 13:
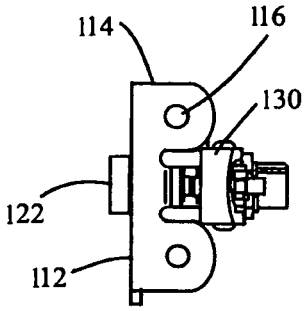
FIG. 13 shows a front view of an embodiment of the latch shown in FIGS. 11 and 12, where the latch is shown in the locked position.
Figure 14:
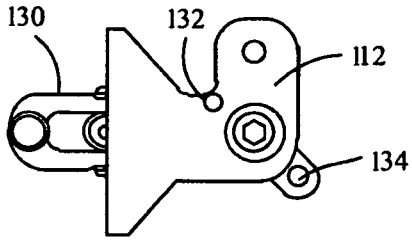
FIG. 14 shows a top view of the embodiment shown in FIG. 13, also in the locked position.
Figure 15:
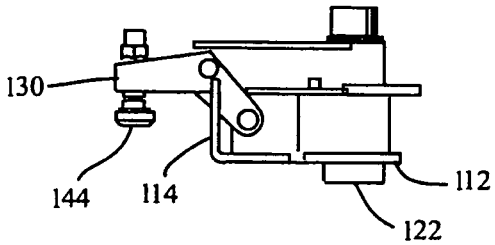
FIG. 15 shows a side view of an embodiment of the latch shown in FIG. 11 in the locked position.

FIG. 13 shows a front view of an embodiment of the latch shown in FIGS. 11 and 12, where the latch is shown in the locked position. The plunger 122 rises above the upper surface of the housing 112, and would be flush with the skin of the panel to which the latch was mounted. The latch would be mounted to the panel using the flange 114 and the apertures 116. FIG. 14 shows a top view of the embodiment shown in FIG. 11, also in the locked position. The latch is in the locked position, as the pivot arm 130 is aligned with the housing 112 and not pivoted beneath the housing 112 such that the panel could be opened. FIG. 15 shows a side view of an embodiment of the latch shown in FIG. 11 in the locked position, wherein the plunger 122 is in a raised position above the housing 112 upper surface and the pivot arm 130 is aligned with the housing 112 upper surface. The flange 114 would be used to mount the housing 112 to the aircraft panel, and the distance can be adjusted to ensure adequate locking pressure between the pivot arm 130 and the panel structure using the screw 140 of the screw subassembly.

Figure 16:
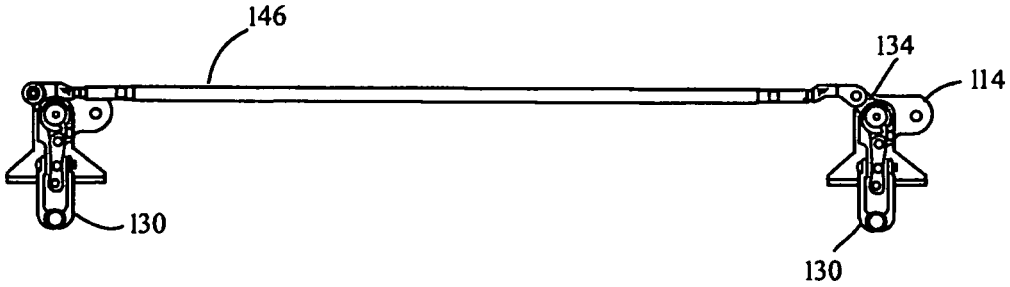
FIG. 16 shows an assembled view of an embodiment of the disclosed latch system.

FIG. 16 shows an assembled view of an embodiment of the disclosed latches linked in a series of two latches. The link rod 146 is attached to the latches using the link rod attachment member 134, and the link rod 146 transmits the rotational force of the lock mechanism through the link rod attachment member 134, causing the pivot arm 130 of all linked latches to pivot in the same direction. The latch is mounted to the panel using the flange 114.

Figure 17:
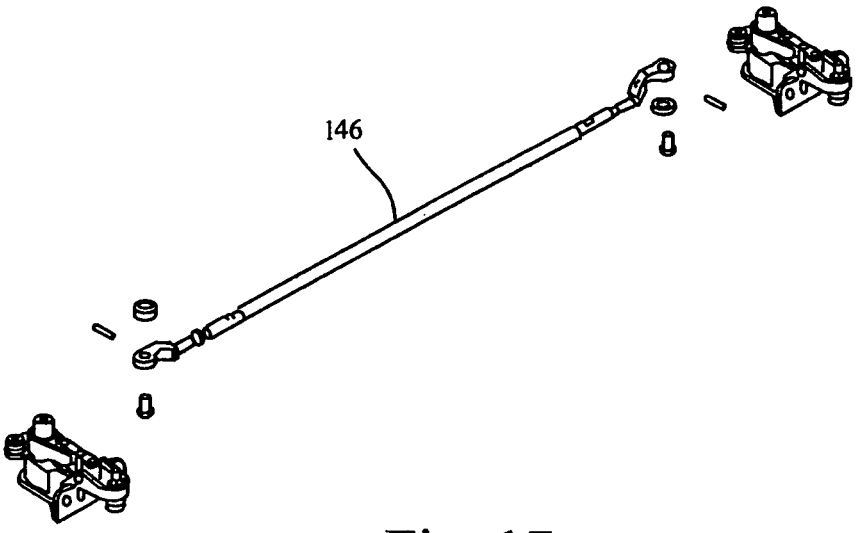
FIG. 17 shows an exploded view of an embodiment of the disclosed latch system shown in FIG. 16 linked in a series of two latches.

FIG. 17 shows an exploded view of a series of two latches linked together in series shown in FIG. 16, and shows how the link rod 146 could be joined to the latches.

Figure 18:
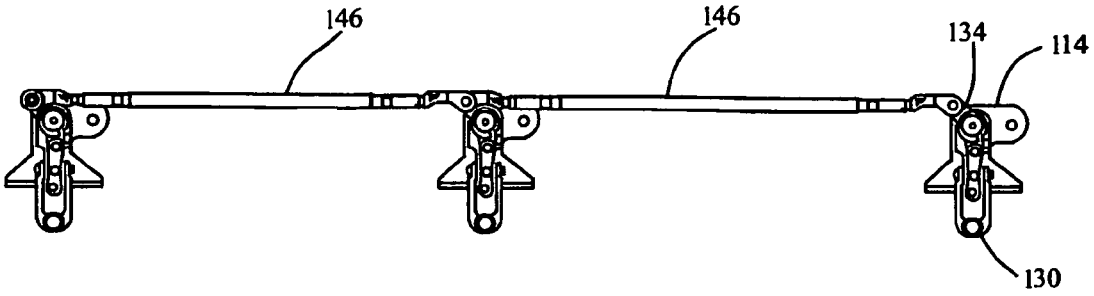
FIG. 18 shows an assembled view of an embodiment of the disclosed latch system.

FIG. 18 shows an assembled view of an embodiment of the disclosed latch, linked in a series of three latches. There are two link rods 146 and the link rods 146 are attached to the link rod attachment member 134. More than three latches may be linked in a series, and a corresponding number of link rods 146 would be used to accomplish the linked series of latches. The pivot arms 130 of the latches are pivoted in the same direction by the rotational force transmitted by the link rod attachment member 134. The flange 114 is used to attach the housing to the panel.

Figure 19:
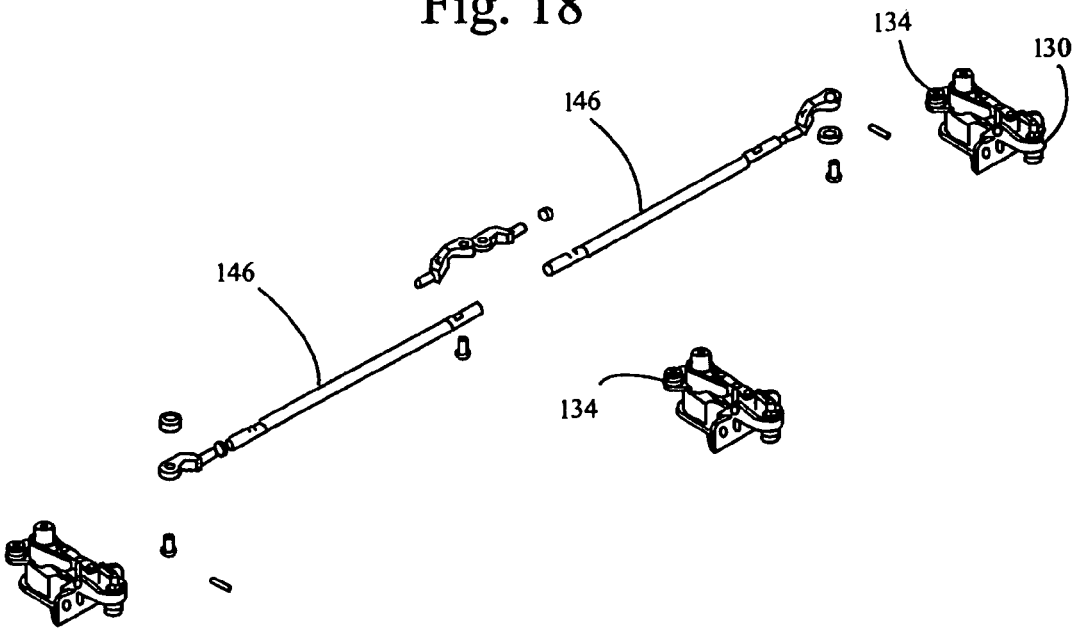
FIG. 19 shows an exploded view of an embodiment of the disclosed latch system shown in FIG. 18 linked in a series of three latches.
Figure 20:
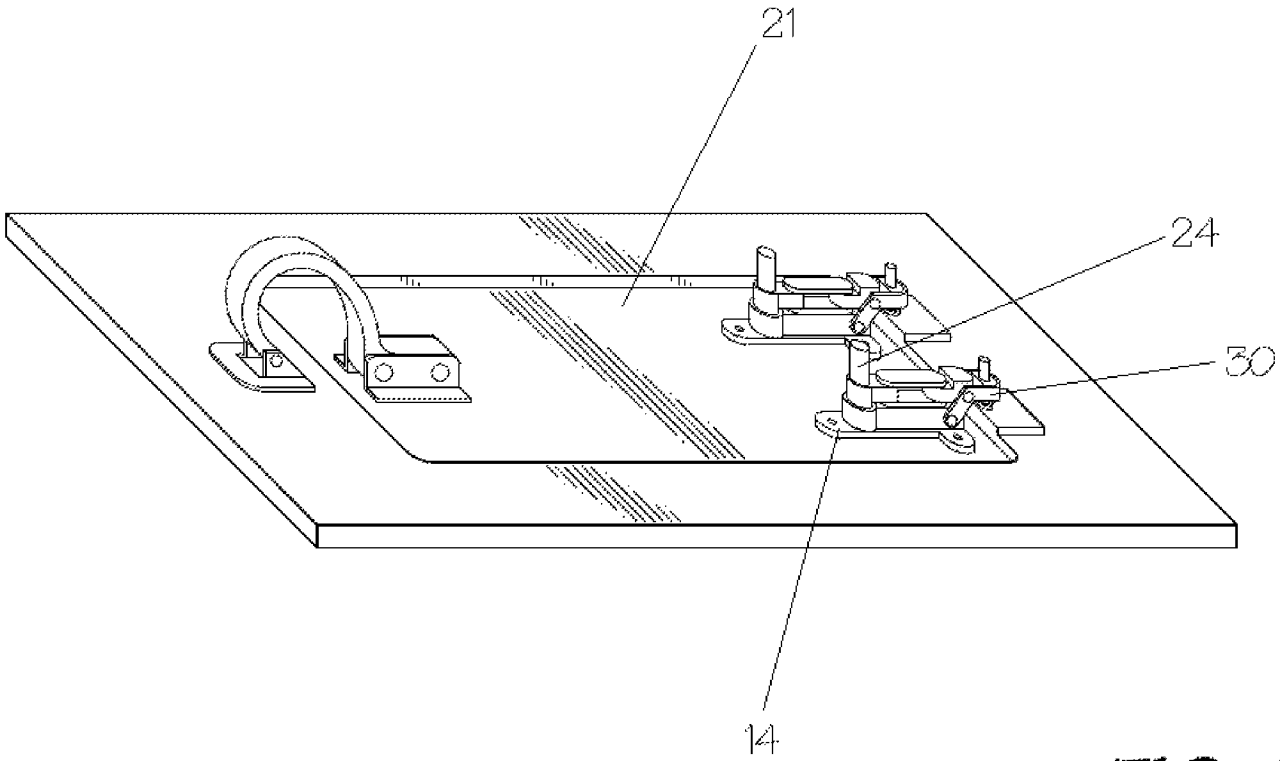
FIG. 20 shows a perspective view of an embodiment of the disclosed latch system, the latch system being associated with a panel.

FIG. 19 shows an exploded view of a series of three latches linked together in series shown in FIG. 18. The Figure shows how the latches may be linked in series using link rods 146 attached to the link rod attachment members 134. The pivot arms 130 are shown in the locked position.

In use it can be seen that the status indicating latch comprises a housing having an upper surface and a central body and a rotatable lock mechanism disposed within the housing and transversing the upper surface and the central body. The lock mechanism can have an activation means, wherein the lock mechanism moves between a first locked position and a second unlocked position, the lock mechanism comprising a shaft, a plunger disposed within the shaft, a cam operatively connected to the plunger, and a plunger biasing means wherein the first locked position corresponds to the plunger biased upwards wherein the plunger raises above the housing surface and the second unlocked position corresponds to the plunger compressing the biasing means such that the plunger is flush with the upper surface. There is a guide operatively connected to the cam, and a pivot arm assembly pivotally connected to the housing central body and slidably connected to the guide. The pivot arm is thus moved into a first lowered position aligned relative to the housing upper surface when the lock mechanism is in the first locked position and a second raised position angled relative to the housing upper surface when the lock mechanism is in the second unlocked position.

The housing can comprise a movement stop that would limit the cam and guide to movement in one direction only. The cam can comprise a link rod attachment member, and the link rod attachment member can be used in conjunction with link rods to transmit the rotational movement imparted to one latch to all latches in the series. As the latches were all moved to the same status, the plungers would also be biased to the same status indication. The biasing means can comprise a spring. The activation means can comprise an activation tool engagement member and an activation tool, such as a hex wrench.

While the above is a description of various embodiments of the present invention, further modifications may be employed without departing from the spirit and scope of the present invention. Thus the scope of the invention should not be limited by the specific structures disclosed. Instead the true scope of the invention should be determined by the appended claims.

What is claimed is:

1. A status indicating latch comprising:

a housing having a flange, said flange having a plurality of apertures transversing said flange, the plurality of apertures each sized and shaped to receive a fastener for attaching said housing to a panel, the housing further comprising a first opening defined therein;

a rotatable lock mechanism disposed within said housing, said lock mechanism comprising a shaft disposed within the first opening defined in the housing, a plunger having an activation tool engagement member associated therewith disposed within said shaft, a cam operatively connected to said plunger such that movement of said plunger causes a corresponding rotational movement of said cam, and a plunger biasing means disposed within said shaft and biasing said plunger beyond an outer surface of the housing such that an outward facing surface of said plunger is flush with an outer surface of a panel when said lock mechanism is in a first locked position;

a guide operatively connected to said cam such that rotational movement of said cam is transmitted to said guide; and a pivot arm pivotally connected to said housing and slidably connected to said guide such that movement of said guide transmitted to said guide by said cam causes the pivot arm to pivot between the first locked and second unlocked positions, wherein the outward facing surface of said plunger is recessed with respect to the outer surface of said panel when said lock mechanism is in a second unlocked position.

2. The status indicating latch of claim 1 wherein said housing further comprises a movement stop blocking rotational movement of said cam in the direction of the movement stop.

3. The status indicating latch of claim 1 wherein said cam further comprises a link rod for attachment to a link rod attachment member for attaching said status indicating latch to a second status indicating latch.

4. The status indicating latch of claim 1 wherein said activation tool engagement member comprises a hex shaft.

5. The status indicating latch of claim 1 wherein said biasing means comprises a spring.

6. A status indicating latch comprising:

a housing having an upper surface and a central body;

a rotatable lock mechanism disposed within said housing and transversing said upper surface and said central body, said lock mechanism comprising an activation means for moving said lock mechanism moves between a first locked position and a second unlocked position, said lock mechanism comprising a shaft disposed within a first opening in said housing, a plunger disposed within said shaft, a cam operatively connected to said plunger such that movement of said plunger causes a corresponding rotational movement of said cam, and a plunger biasing means disposed within said shaft wherein said first locked position corresponds to said plunger biased upwards wherein said plunger raises above said upper surface and said second unlocked position corresponds to said plunger compressing said biasing means such that said plunger is flush with said upper surface;

a guide operatively connected to said cam such that rotational movement of said cam is transmitted to said guide; and a pivot arm assembly pivotally connected to said housing central body and slidably connected to said guide such that movement of said guide transmitted to said guide by said cam causes the pivot arm to pivot between the first locked and second unlocked positions, wherein said pivot arm is moved into a first raised position aligned relative to said upper surface when said lock mechanism is in said first locked position and a second lowered position angled relative to said upper surface when said lock mechanism is in said second unlocked position.

7. The status indicating latch of claim 6 wherein said housing further comprises a movement stop blocking rotational movement of said cam in the direction of the movement stop.

8. The status indicating latch of claim 6 wherein said cam further comprises a link rod for attachment to a link rod attachment member for attaching said status indicating latch to a second status indicating latch.

9. The status indicating latch of claim 6 wherein said biasing means comprises a spring.

10. The status indicating latch of claim 6 wherein said activation means comprises an activation tool engagement member and an activation tool.

11. The status indicating latch of claim 10 wherein said activation tool comprises a hex wrench.

12. A status indicating latch comprising:

a housing having a flange, said flange having a plurality of apertures transversing said flange the plurality of apertures each sized and shaped to receive a fastener for attaching said housing to a panel, the housing further comprising a first opening defined therein;

a rotatable lock mechanism disposed within said housing, said lock mechanism comprising a shaft disposed within the first opening defined in the housing, a plunger having an activation tool engagement member associated therewith disposed within said shaft, a cam operatively connected to said plunger such that movement of said plunger causes a corresponding rotational movement of said cam, said cam further comprising a link rod attachment member, and a plunger biasing means biasing said plunger beyond an upper surface of said housing when said lock mechanism is in a first locked position;

a guide operatively connected to said cam such that rotational movement of said cam is transmitted to said guide; and a pivot arm pivotally connected to said housing and slidably connected to said guide such that movement of said guide transmitted to said guide by said cam causes the pivot arm to pivto between the the first locked and a second unlocked position.

13. The status indicating latch of claim 12 wherein said housing further comprises a movement stop blocking rotational movement of said cam in the direction of the movement stop.

14. The status indicating latch of claim 12 wherein said activation tool engagement member comprises a hex shaft.

15. The status indicating latch of claim 14 further comprising an activation tool, wherein said activation tool comprises a hex wrench.

16. The status indicating latch of claim 12 further comprising an activation tool, wherein said activation too comprises a hex wrench.

17. The status indicating latch of claim 12 wherein said biasing means comprises a spring.

18. The status indicating latch of claim 12 wherein said pivot arm further comprises a screw subassembly, said screw subassembly further comprises a screw, a screw locking insert, and a self-locking nut.

19. The status indicating latch of claim 12 wherein link rod attachment member connects to a plurality of link rods.

20. The status indicating latch of claim 1 wherein the plunger is flush with an outer surface of said housing when said lock mechanism is in a second unlocked position.

* * * * *